United States Patent [19]

Ivey

[11] Patent Number: 4,549,411

[45] Date of Patent: Oct. 29, 1985

[54] JEWELRY CHAIN ORGANIZER

[76] Inventor: Alma T. Ivey, 7309 McCormack Dr., Hixson, Tenn. 37343

[21] Appl. No.: 469,400

[22] Filed: Feb. 24, 1983

[51] Int. Cl.[4] ..... A44C 25/00

[52] U.S. Cl. ..... 63/2; 24/298

[58] Field of Search ..... 63/1, 2, 3, 4; 24/116 R, 116 A, 129 R, 132 R, 132 AA, 298, 299; 174/46; 245/4

[56] References Cited

U.S. PATENT DOCUMENTS 2,867,052 1/1959 Feilbelman ..... 24/116 A

FOREIGN PATENT DOCUMENTS 217352 9/1958 Australia ..... 63/2
2309227 8/1974 Fed. Rep. of Germany ..... 63/2
1142207 3/1957 France ..... 63/1 R

*Primary Examiner*—F. Barry Shay
*Attorney, Agent, or Firm*—Harvey B. Jacobson

[57] ABSTRACT

A device for maintaining a plurality of jewelry neck chains, arm or wrist chains and the like in a predetermined relationship in order to retain the jewelry chains in generally parallel, side-by-side relation thereby reducing the tendency of adjacent jewelry chains from becoming entangled with each other when being worn. In one embodiment of the invention, the device is in the form of an elongated flat bar having a plurality of apertures therein with each aperture adapted to receive a split ring clasp used to secure the ends of jewelry chains together in order to maintain the clasp and thus the ends of the jewelry chain in spaced relation to each other with the jewelry chains being maintained generally in parallel relation to each other. In another embodiment of the invention, the device is in the form of a clamp having two elongated leg portions for clampingly engaging jewelry chains therebetween adjacent the clasps which secure the chains together in order to retain; the chains in spaced generally parallel relation. Another embodiment of the device is in the form of a ring structure having a diameter sufficient for the ring to extend through split ring-type clasps of a plurality of jewelry chains. The device may be constructed in the form of a plurality of loops, chain links or the like, and may be constructed of various materials including precious metals, plated metals, plastics, plated plastics and the like with the organizer being associated with a plurality of existing complete jewelry items and serving to keep the chains in somewhat parallel arrangement to reduce their tendency to become entangled and to serve as a safety device in that if one of the chains breaks the broken chain will be retained by the organizer rather than falling unnoticed from the wearer's neck, arm or the like.

1 Claim, 6 Drawing Figures

JEWELRY CHAIN ORGANIZER

BACKGROUND OF THE INVENTION

1. Field of the Invention

The present invention really relates to a jewelry chain organizer and more specifically to a device which is engaged with a plurality of jewelry chains in a manner to retain the clasp portions of the jewelry chains in predetermined orientation in order to prevent the clasp portions of the chains from becoming entangled in order to maintain the jewelry chains in a neat and attractive arrangement and also facilitate the assembly and disassembly of the jewelry chains when desired by the wearer. Also, the jewelry chain organizer will support a broken chain from the other chains being worn thereby preventing a broken chain from merely falling from the wearer.

2. Description of the Prior Art

The following prior U.S. patents relate to the jewelry chain organizer of the present invention:

U.S. Pat. No. 2,529,058, Nov. 7, 1950
U.S. Pat. No. 2,586,758, Feb. 19, 1952
U.S. Pat. No. 2,830,347, Apr. 15, 1958
U.S. Pat. No. 2,867,052, Jan. 6, 1959
U.S. Pat. No. 3,135,031, June 2, 1964
U.S. Pat. No. 3,181,217, May 4, 1965
U.S. Pat. No. 3,208,238, Sept. 18, 1965
U.S. Pat. No. 3,545,200, Dec. 8, 1970

U.S. Pat. No. 2,529,058 discloses a fitting for a multiple string of beads or the like which recomes an integral part of the beads. U.S. Pat. No. 2,586,758 discloses a structure by which strands are interconnected and it is used to change the manner in which a necklace may be worn from time to time as may be preferred by the wearer. U.S. Pat. No. 2,830,347 discloses a chain slide for varying the size of a loop of a necklace or other item of jewelry. U.S. Pat. No. 2,867,052 discloses a structure for beads or necklaces and bracelets which are threaded on a string so that a single strand may be converted into a multiple strand. U.S. Pat. No. 3,135,031 discloses a device for rethreading beads or pearls. U.S. Pat. No. 3,181,217 discloses a jewelery shortener lock to vary the length of beads or the like. U.S. Pat. No. 3,208,238 discloses a clasp that is affixed to the strands of beads. U.S. Pat. No. 3,545,200 discloses a connector or clasp for connecting the ends of a link-type chain.

The above mentioned patents fail to disclose a structure that can be associated with various types and numbers of jewelery chains to retain the clasps that already exist on the chain and adjacent portions of the chains themselves in close relation to each other, in general alignment with each other and in a constant linear orientation in relation to each other thereby preventing the clasp of a chain from migrating around the neck or wrist of a wearer so that the clasp becomes observable and not in alignment with the other clasps and also preventing the clasp areas of the jewelry chains from becoming intertwined and entangled.

SUMMARY OF THE INVENTION

An object of the present invention is to provide an organizer for connection with or engagement with a plurality of jewelry chains to maintain the chains in generally parallel relation and to prevent the chains from moving to any substantial extent in a linear direction thereby organizing the plurality of chains and maintaining them in the organized relationship.

Another object of the invention is to provide a jewelry chain organizer in the form of an elongated, generally flat member of any suitable configuration having a plurality of apertures therethrough adapted to receive the conventional split ring clasp used to connect adjacent ends of jewelry chains together to retain the clasps and adjacent portions of the chains in spaced, generally parallel relation and to prevent the chains from moving in a linear manner in relation to each other and to support the jewelry chains from each other to prevent loss of one or more of the jewelry chains in the event it becomes broken.

A further object of the invention is to provide a jewelry chain organizer in the form of an elongated clamp having generally parallel elongated clamping legs with one pair of adjacent ends being connectible and disconnectible to clampingly engage a plurality of jewelry chains adjacent the clasp to enable the organizer to be used regardless of the type of chains and clasps being used.

Yet another object of the invention is to provide a jewelry chain organizer in the form of an enlarged ring capable of being inserted through or received in a plurality of split ring-type clasps.

A still further object of the invention is to provide a jewelry chain orginizer which may be constructed of precious metal, plated metal or other metal, plastic material or the like thereby providing an economically feasible and ornamentally attractive jewelry chain organizer which functions to maintain a plurality of jewelry chains in organized relation and is capable of use with various types of jewelry chains and serves as a safety device to prevent accidental loss of one or more jewelry chains in the event of breakage.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
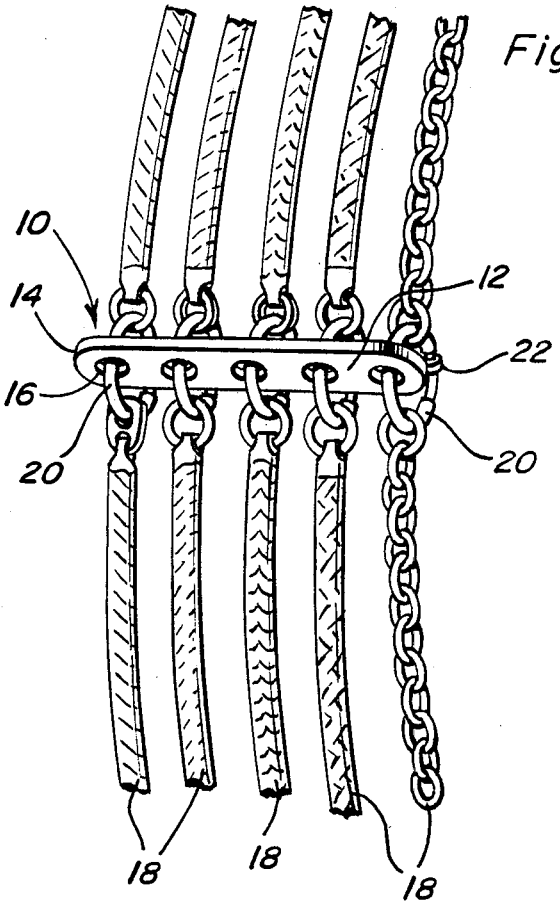
FIG. 1 is a perspective view of one embodiment of the jewelry chain organizer of the present invention.
Figure 2:
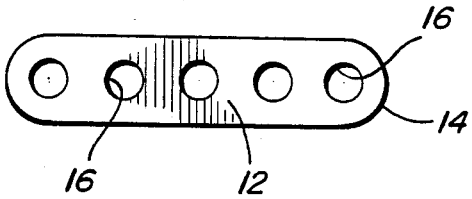
FIG. 2 is a plan view of the organizer of FIG. 1.

Referring now specifically to FIGS. 1 and 2, the jewelry chain organizer illustrated therein is generally designated by reference numeral 10 and is in the form of an elongated, generally flat plate 12 having parallel side edges and substantially planar surfaces. The ends of the plate 12 are rounded as at 14 and a plurality of equally spaced apertures 16 are formed in the plate along the longitudinal center line thereof with the length of the plate and the number of apertures varying depending upon the number of jewelry chains 18 to be associated therewith. As illustrated in FIG. 1 each jewelry chain 18 is provided with a conventional split ring clasp 20 which has a spring biased movable component 22 forming an opening in the ring 20 when in open position and closing that opening when in closed position in a conventional manner. This enables the split ring clasp 20 to be engaged with the apertures 16 in the plate 12 as illustrated in FIG. 1 so that the clasps 20 are maintained in spaced relation to each other, and the adjacent portions of the chains 18 are generally maintained in parallel association with each other. Also, the engagement of the clasp 20 with the organizer 10 prevents the jewelry chains 18 from moving in a linear manner in relation to each other thereby retaining all of the clasps 20 generally in alignment. For example, when the jewelry chain organizer 10 is used with necklaces or neck encircling chains, the organizer 10 will retain all of the clasps 20 located in alignment along the rear surface of the neck thereby precluding one or more of the chains from moving around the neck so that the clasp is visible from the front of the wearer. Also, maintaining the clasps 20 in aligned spaced relation will reduce the tendency of the neck chains from becoming entangled as some times occurs when the clasps and adjacent portions of the chains becoe intertwined during normal movements by the wearer. Also, if one of the chains 18 breaks anywhere along the length of the chain or where one portion of the chain connects to the split ring clasp 20, the broken chain will be supported from the organizer 10.

Figure 3:
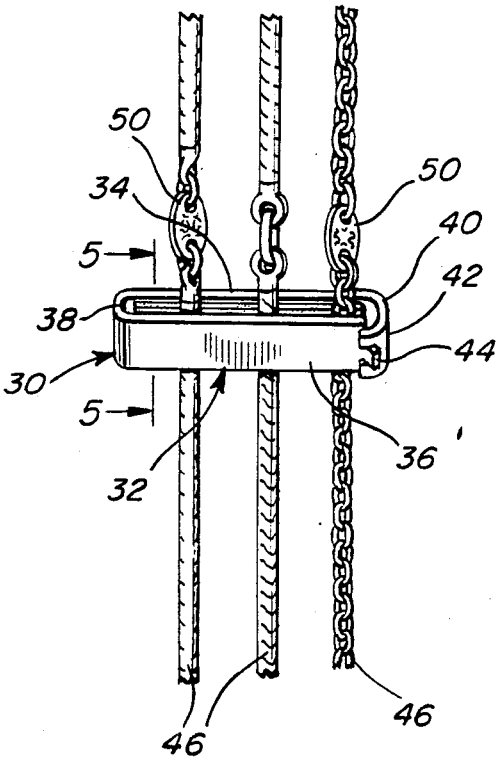
FIG. 3 is a perspective view of another embodiment of the jewelry chain organizer.
Figure 5:
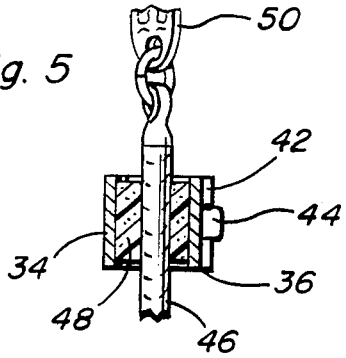
FIG. 5 is a sectional view taken substantially upon a plane passing along section line 5—5 on FIG. 3 illustrating the relationship of the organizer to the jewelry chain.
Figure 4:
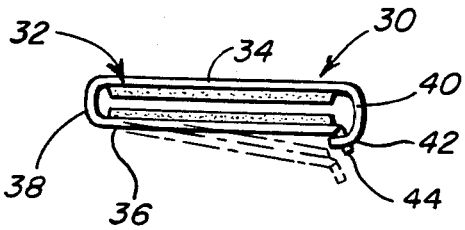
FIG. 4 is a plan view of the organizer of FIG. 3.

FIGS. 3–5 illustrate another embodiment of the jewelery chain organizer 30 which is a clamp-type and includes an elongated clamp member 32 having a pair of elongated generally parallel legs 34 and 36 which are connected to each other by a U-shaped connecting portion or bight portion 38 which enables the other end portions of the legs 34 and 36 to spread apart as illustrated in FIG. 4. The leg 34 has a curved end portion 40 opposite the bight portion 38 which terminates in a bifurcated inwardly turned end portion 42 which straddles and receives an outwardly projecting tongue 44 on the end of the leg 36 remote from the bight portion 38. As illustrated, the outwardly curved tongue 44 is of reduced width and is received in the bifurcated end 42 of the forwardly and inwardly curved portion 40 which is integral with the leg 34. The clamp 32 is constructed so that the legs 34 and 36 will diverge away from the bight portion 38 so that when the tongue 44 is disconnected from the bifurcated end 42 by flexing the bifurcated end 42 away from its overlying engagement with the outer surface of the leg 36, the leg 36 will move to the dotted line position illustrated in FIG. 4 so that a plurality of jewelry chains 46 may be inserted between the legs 34 and 36 after which the leg 36 can be moved to a closed position by squeezing it inwardly and deflecting the bifurcated end 42 outwardly temporarily until it snaps back into engagement with the outer surfaces of the leg 36 as illustrated in FIG. 3. The inner surface of each of the legs 34 and 36 is provided with a lining of resilient cushioning material 48 to enable effective gripping engagement with the jewelry chains 46 regardless of the specific configuration and dimensional characteristics of the jewelry chains.

As illustrated in FIG. 3, the organizer 30 is engaged with chains 46 adjacent the clasps 50 which connect the adjacent ends of the chains 46 thereby enabling the clamp-type organizer 30 to be used with chains having any type of clasps including those which have very small split rings, pivoted latch elements or any other kind of structure used for connecting adjacent ends of jewelry chains. This structure also enables the chains to be positioned around the neck, wrist or the like and the organizer 30 then positioned on the chains thereby facilitating assembly and disassembly of the organizer with respect to the jewelry chains 46.

Figure 6:
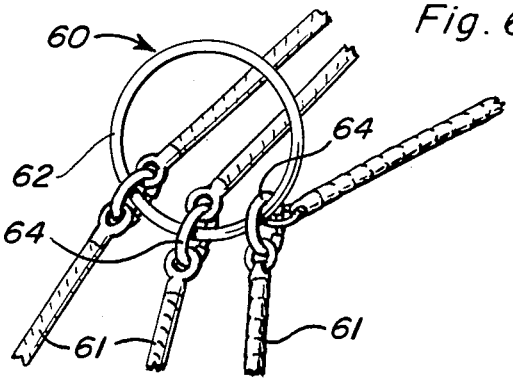
FIG. 6 is a perspective view of another embodiment of the jewelry chain organizer.

FIG. 6 illustrates another embodiment of the chain organizer 60 which is in the form of an enlarged ring 62 which is associated with split ring clasps 64 in jewelry chains 61. The diameter of the ring 62 is such that it can be easily associated with a plurality of clasps 64 to maintain the clasps in proper orientation with respect to each other. The ring 62 can be a continuous one-piece member or it may be a split ring itself which enables the ring to be assembled with the clasps 64 after the jewelry chains have been placed around the neck of the wearer.

The organizer may itself be an item of jewelry and be constructed of various materials including metal, precious metals, plated metals or plastic materials and the like, and primarily maintains the closures or clasps of multiple neck chains, arm chains, jewelry chains of various types, in organized or adjacent relation with the corresponding portions of the chains being retained generally in parallel relation. The dimensional characteristics may varying as may the particular configuration thereof. The organizer is used with complete items of jewelry and may be used or not used as desired without damage to the chains and without changing the normal function of the jewelry chains. The clamp-type organizer can be used with chains that do not have clasps, such as those that are merely placed over the head and around the neck. The shape and configuration of the plate may vary and in itself may be a plurality of chain links either rigidly connected or connected in the nature of a conventional chain. The organizer not only retains the clasps in positions but also maintains the chains in proper association so that they do not move in a linear manner about the neck or arm of the wearer and also serves as a safety device to interconnect the plurality of chains so that in the event one of them becomes broken it will not merely fall off the wearer.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, a plurality of flexible jewelry chains adapted to be oriented in encircling relation to the neck, wrist, arm or the like of a wearer, each chain including an openable fastener detechably connecting the ends of the chain together, said chains being free of each other and having a length rendering them sufficiently loose in their embrace of the member they are intended to encircle so that the chains have a tendency to become entangled by intertwining and the fasteners have a tendency to become remotely spaced from one another about the member by moving in linear relation to each other, an organizer for maintaining the plurality of said jewelry chains in predetermined relationship with the fasteners in adjacent, generally aligned relation, said organizer comprising an elongated body having means incorporated therein releasably connected with all of the plurality of jewelry chains without modifying the capability for independent use of such chains and without modifying the structural characteristics thereof, said means connected with the jewelry chains reducing the tendency of the chains to become entangled by intertwining and preventing such misalignment and remote spacing of the fasteners by preventing relative linear movement of the chains by preventing displacement of the portions of the chains connected with the organizer, said elongated body including a generally thin, narrow, flat plate extending generally transversely to said plurality of chains, said means connected with the chains and maintaining the relationship thereof including a plurality of apertures in the plate, each of the chain fasteners including an openable split ring directly joining end links of its associated chain through a respective one of the apertures, said apertures being spaced along the longitudinal center line of the plate to retain the split rings in aligned spaced relation, said plate including parallel side edges and rounded ends and being constructed as a decorative and ornamental jewelry item.

* * * * *